US005409214A

United States Patent [19]

Cook

[11] Patent Number: 5,409,214

[45] Date of Patent: Apr. 25, 1995

[54] BASEBALL BAT

[75] Inventor: David C. Cook, Porter County, Ind.

[73] Assignee: McLellan-Cook Sports, Inc., Valparaiso, Ind.

[21] Appl. No.: 301,471

[22] Filed: Sep. 7, 1994

Related U.S. Application Data

[63] Continuation of Ser. No. 89,337, Jul. 12, 1993.

[51] Int. Cl.[6] ..... A63B 59/06

[52] U.S. Cl. ..... 273/72 R; 273/72 A

[58] Field of Search ..... 273/72 R, 72 A, 67 R, 273/67 A, 73 J, 81 R, 80 R, 80.4, 80.8

[56] References Cited

U.S. PATENT DOCUMENTS

| | | | |
|---|---|---|---|
| 1,665,195 | 4/1928 | Cohn | 273/72 R |
| 2,195,681 | 4/1940 | Robarge | 273/72 R |
| 3,129,003 | 4/1964 | Mueller et al. | 273/72 R |
| 3,479,030 | 11/1969 | Merola | 273/72 A |
| 3,877,698 | 4/1975 | Volpe | 273/72 R |
| 4,714,251 | 12/1987 | Cook | 273/72 R |

*Primary Examiner*—Mark S. Graham
*Attorney, Agent, or Firm*—James D. Hall

[57] ABSTRACT

A baseball bat which includes a handle part formed of metal, metal alloy or filter composite material, and a hitting part formed of wood. The hitting part may be of single-piece construction or may be formed of two or more pieces of wood connected by finger joints.

4 Claims, 2 Drawing Sheets

BASEBALL BAT

This is a continuation of application Ser. No. 08/089,337, filed on Jul. 12, 1993.

BACKGROUND OF THE INVENTION

This invention relates to bats and will have application to a composite baseball bat.

Baseball and softball bats are currently formed of a single piece of turned wood or of cast aluminum. My U.S. Pat. No. 4,714,251 shows a three-piece bat with the individual sections connected by adhesive-filled finger joints.

The predominant bat in organized amateur baseball leagues is made of aluminum. Only wood bats may be used in the professional leagues, both in the minor leagues all the way up to the major leagues. Aluminum bats are used in amateur baseball because of their durability and hitting power.

Unfortunately, the aspiring professional baseball player who attempts to make the transition from the aluminum to the wood bat is often disillusioned. Because of the expanded sweet spot of the aluminum bat, more balls are hit hard than with the traditional wood bat. Also, the relative softness of the wood bat makes the ball spin more than the aluminum bat, which often turns a potential extra base hit into a disappointing foul ball. As a result, many fine hitters, considered good major league prospects in amateur baseball become poor or ordinary hitters when forced to use the wood bat. In many cases, this is due not to an erosion of ability, but an erosion of the player's confidence.

SUMMARY OF THE INVENTION

The bat of this invention is designed to lessen and even eliminate the aluminum-to-wood transition, and still provide a durable bat which will accommodate the budgets of most amateur leagues. The bat includes a hollow handle portion formed of metal or a composite material which is highly resistant to breakage. The hitting portion of the bat is formed of wood, either the traditional one-piece type, or the modified two or three-piece type shown in my U.S. Pat. No. 4,714,251, incorporated herein by reference. The hitting portion is secured in the handle by an appropriate adhesive.

Accordingly, it is an object of this invention to provide for a novel and improved bat.

Another object is to provide for a baseball bat which produces the hitting power and feel of a one-piece wood bat, and which is durable and break-resistant.

Another object is to provide for a baseball bat which is a viable economic alternative to one-piece aluminum bats.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 3:
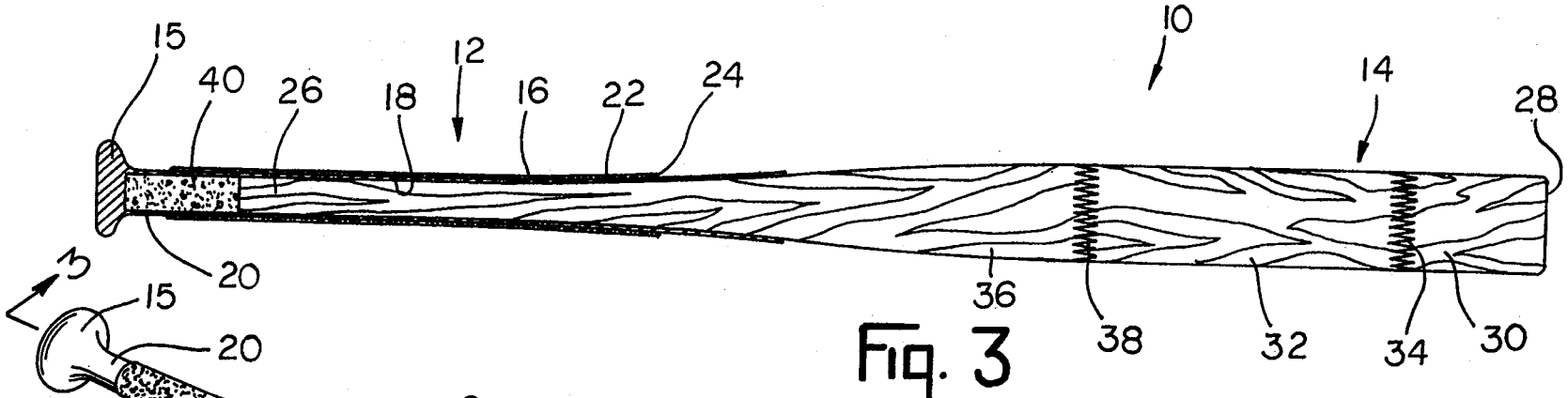
FIG. 3 is a sectional view taken along line 3—3 of FIG. 1.
Figure 1:
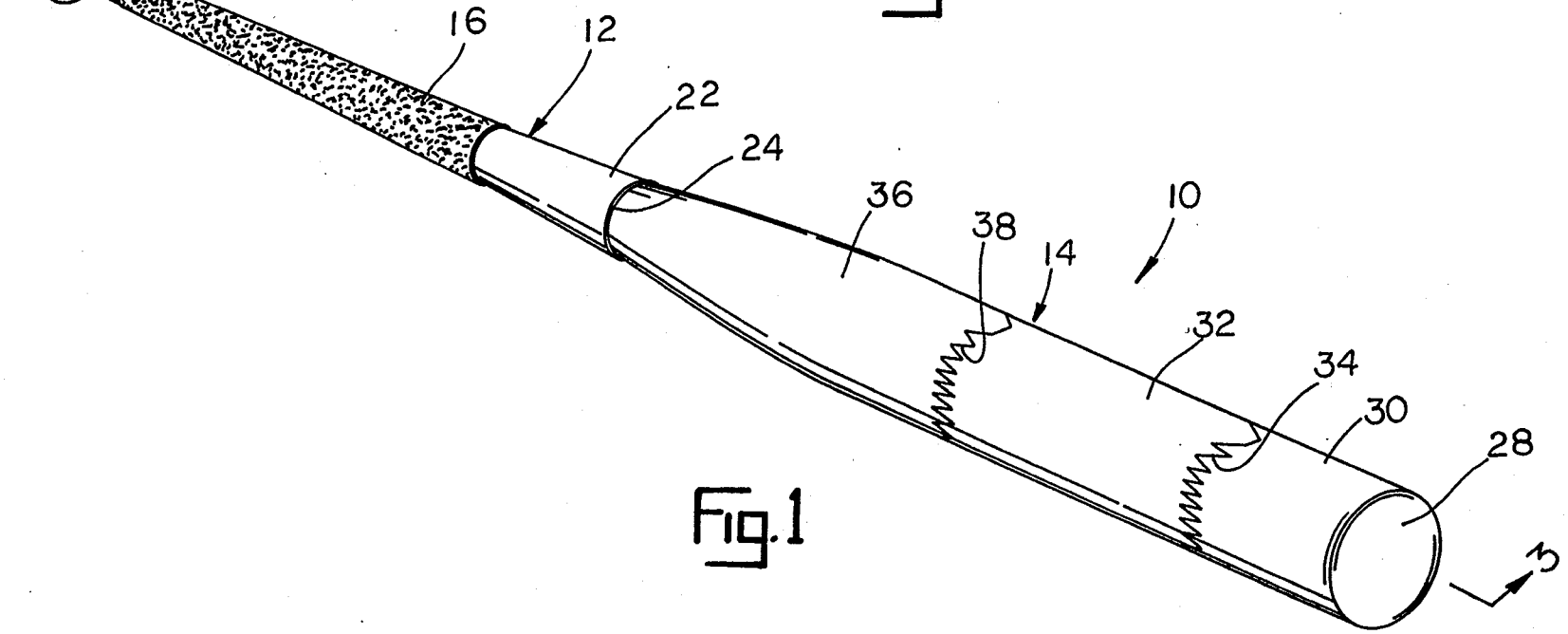
FIG. 1 is a perspective view of the baseball bat of this invention.
Figure 2:
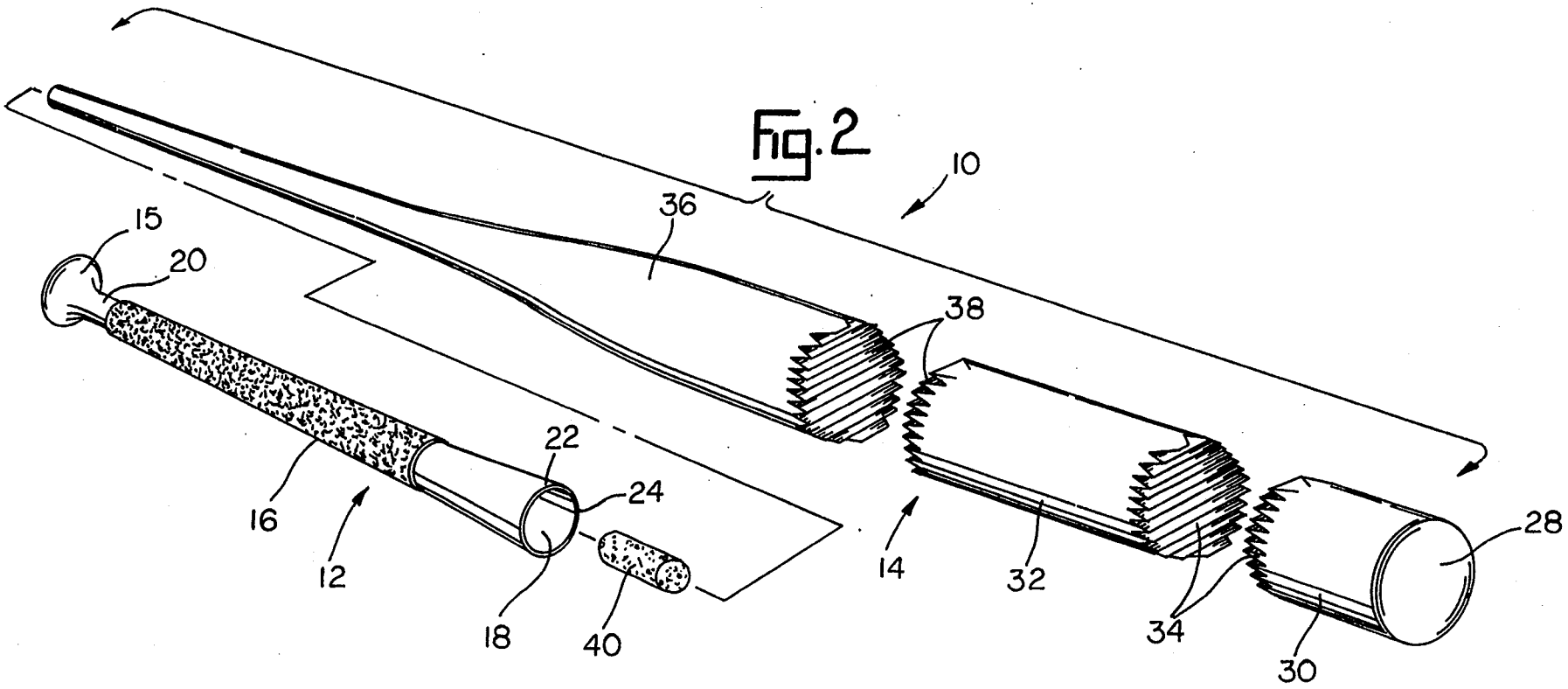
FIG. 2 is an exploded view of the bat of FIG. 1.

The preferred embodiment herein described is not intended to be exhaustive or to limit the invention to the precise form disclosed. It is chosen and described to explain the principles of the invention and its application and practical use to enable others skilled in the art to utilize the teachings thereof.

Referring to the drawings, reference numeral 10 generally designates the bat of this invention. Although the primary uses of bat 10 will be baseball teams, the construction of the bat is such that it may be used by softball teams as well.

Bat 10 includes a handle member 12 and a hitting member 14. Handle member 12 is formed of a one-piece metal or composite construction which preferably has a high tolerance to breakage from the impact and vibrational forces generated during ball striking. Some acceptable metals and composites include aluminum, stainless steel, fibrous composites and any other acceptable metal alloy which is possessed of a light density and high durability.

Handle 12 is preferable hollow and is configured generally as shown in the drawings. Knob 15 is defined at the proximal end of handle 12 to ensure that the hitter's hands stay on the bat 10 during a swing. Handle 12 may be covered by any suitable grip 16 which is a common item used with conventional aluminum bats to prevent hand slippage during a swing. Grip 16 may be formed of rubber, composites of synthetic rubbers, foams, tapes or other suitable material.

The hollow construction of handle 12 includes the circumferentially extending wall defining a tapering inner chamber 18. Handle 12 may be formed as shown in the drawings with a narrowed portion 20 adjacent the knob 15 and an outwardly flared portion 22 near the distal end 24 of the handle.

Hitting member 14 may be formed of a single piece of wood, usually ash or may be formed of a multiple piece construction as shown. Hitting member 14 is defined by handle 26 and tapering barrel end 28 which extends outwardly from handle 12.

Barrel end 28 as shown includes a distal end wood piece 30 preferably formed of ash, pine or maple wood and is connected to striking piece 32 as by first finger joints 34 and a suitable adhesive as described in my U.S. Pat. No. 4,714,251. Striking piece 32 is preferably formed of a relatively dense wood such as hickory or the like, and is connected to proximal end piece 36 as by finger joints 38 and a suitable adhesive. End piece 36 defines handle end 26 described above and is preferably formed of ash.

Bat 10 is constructed as follows. Adhesive is introduced into chamber 18 and to the inner walls of the chamber. Adhesive is also applied to handle end 26 of hitting member 14 which is inserted into chamber 18 and the adhesive allowed to cure. Preferably, the dimensions of handle end 26 are very close to the inner dimensions of handle 12 to ensure a tight fit. This lessens the vibrational shock transmitted to the hands when the ball is struck and also provides dimensional stability for the wood and lessens the chance of breakage. Finally, the proximal end of handle end 26 is preferably about an inch or two from knob 15 with the space filled by a conventional bat filler 40.

Bat 10, so constructed produces the hitting power and feel of a conventional all wood bat. The reinforcing structure of handle 12 also allows the hitting member 14 to greatly resist cracking in this most vulnerable area, namely the relatively thin handle end 26.

It is understood that the above description does not limit the invention to the precise details given, but may be modified within the scope of the following claims.

What is claimed is:

1. A baseball bat comprising a hollow handle member and a solid wooden hitting member, said handle member being formed of a rigid metallic or rigid fiber composite compound and having a knob at one end thereof and an outwardly flared, circumferentially extending wall extending from said knob and terminating in an open opposite end, said circumferentially extending wall defining a tapering chamber tapering from said opposite end toward said knob, said hitting member having a tapering end portion received within said tapering chamber, said tapering end portion terminating in an end surface cooperating with said one end to define a gap therebetween, and means for fixedly joining said tapering end portion of the hitting member to the circumferentially extending wall of the handle member.

2. The baseball bat of claim 1, wherein a filler material fills said gap between said end surface and said one end.

3. The baseball bat of claim 1 wherein said handle member is formed from metal or a metal alloy compound.

4. The baseball bat of claim 1 wherein said hitting member includes a first light wood part having first finger joints defined on a terminal edge thereof, and a second wood part of heavier wood than said first wood part, said second wood part having second finger joints complemental with respect to said first finger joints, and means for fixedly connecting said first wood part and second wood part at said first and second finger joints.

* * * * *